United States Patent [19]

Knowles

[11] 4,002,116

[45] Jan. 11, 1977

[54] APPARATUS FOR FORMING TRUSSES

[75] Inventor: James Knowles, Bloomfield Hills, Mich.

[73] Assignee: Jack N. Schmitt, Birmingham, Mich.

[22] Filed: May 9, 1975

[21] Appl. No.: 576,031

[52] U.S. Cl. ..... 100/100; 100/208; 100/231; 100/269 R; 100/266; 100/DIG. 13; 227/152

[51] Int. Cl.[2] ..... B30B 1/32

[58] Field of Search ..... 100/100, 231, 269 R, 100/266, 208, DIG. 13; 227/152; 269/321 F; 144/281 C; 29/432

[56] References Cited

UNITED STATES PATENTS

| | | | |
|---|---|---|---|
| 3,100,301 | 8/1963 | Black | 100/DIG. 13 |
| 3,244,091 | 4/1966 | Anderson et al. | 100/266 |
| 3,388,657 | 6/1968 | Jureit | 100/208 |
| 3,495,527 | 2/1970 | Lafreniere | 100/266 |
| 3,866,530 | 2/1975 | Moehlenpah | 100/100 |

*Primary Examiner*—Billy J. Wilhite
*Attorney, Agent, or Firm*—Cullen, Settle, Sloman & Cantor

[57] ABSTRACT

A V-shaped, substantially flat, sheet metal, combined web-connector plate having diverging web-forming legs and integral apex and leg end connector portions provided with struck-out teeth for embedding within spaced apart wooden chord members to form a wood chord-metal web type truss. The truss is assembled upon an apparatus including a horizontal support surface, chord support means for removably positioning the chords above the support surface and means for positioning a number of truss-web connectors beneath the chords, with their teeth extending upwardly towards the chords. Additional web-connectors are located loosely upon the upper surfaces of the chords. A two-unit press is supported upon the support surface on opposite sides of the chords for movement parallel to the chords, and is provided with clamp pressure means which overlap selected apex and leg connector portions on both chords and simultaneously squeeze them toward the chords for embedding their teeth therein. Thus, the finished truss formed on such apparatus is provided with horizontal parallel chords with numerous vertically arranged metal webs located on opposite vertical sides of the chords and secured only to the side faces of the chords by the embedded teeth.

8 Claims, 15 Drawing Figures

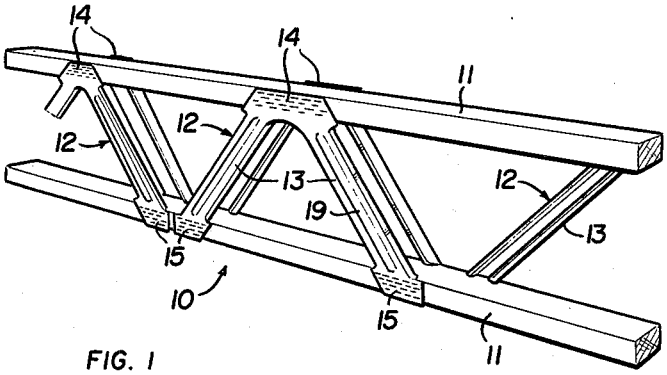
FIG. 1
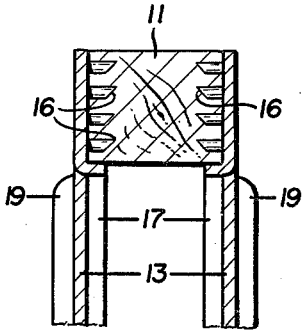
FIG. 2
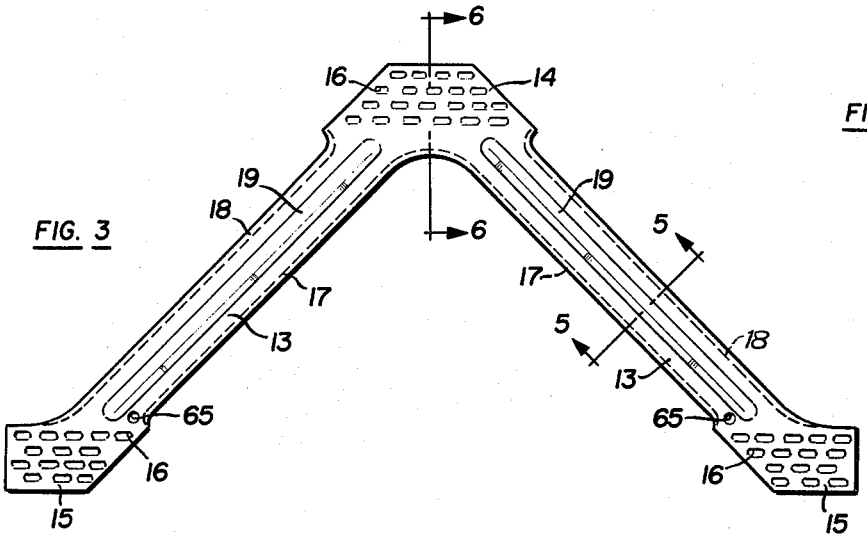
FIG. 3
FIG. 4
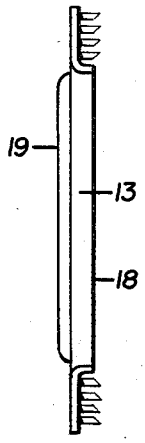
FIG. 5
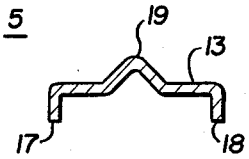
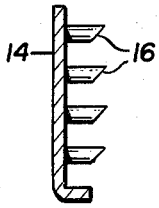
FIG. 6
FIG. 7
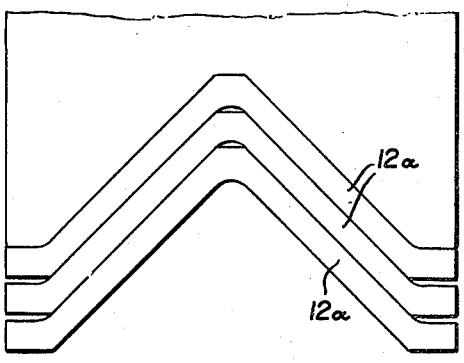

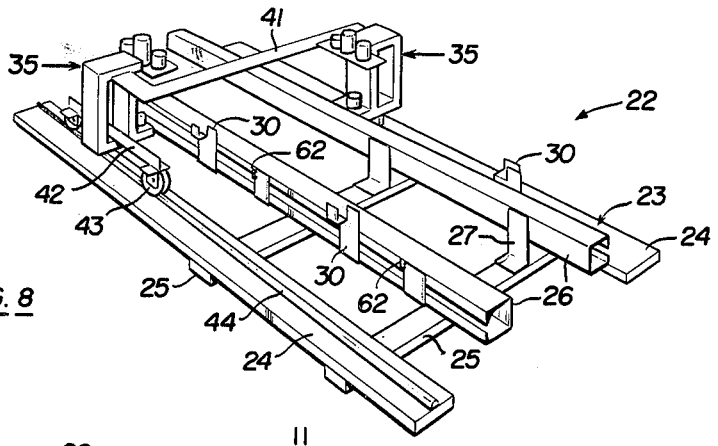
FIG. 8
FIG. 9
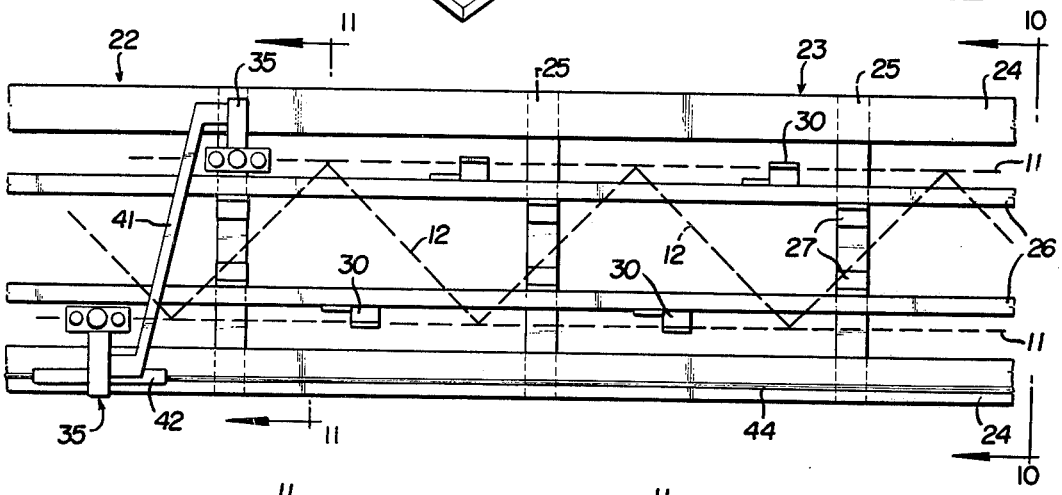
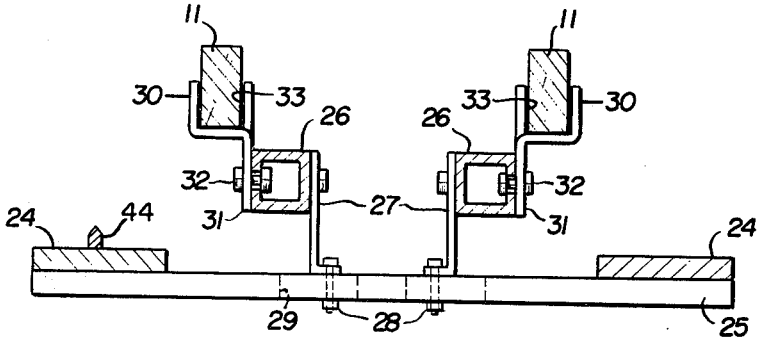
FIG. 10
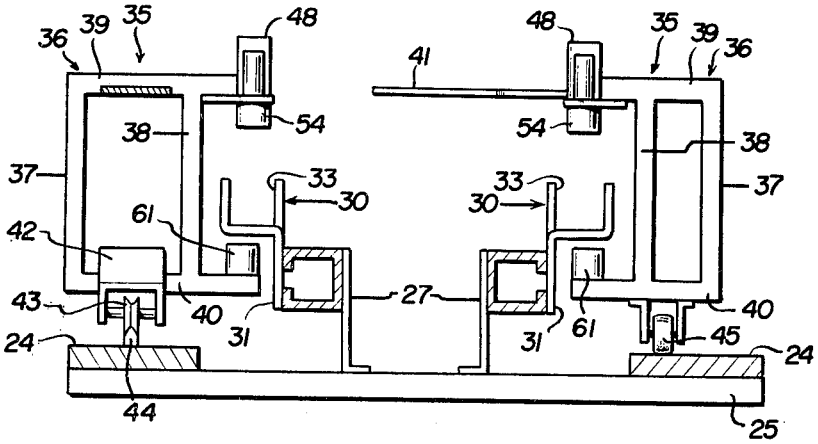
FIG. 11

APPARATUS FOR FORMING TRUSSES

BACKGROUND OF INVENTION

One type of conventional floor truss which is used for supporting building floor surfaces, roof decks and the like, is formed of a pair of parallel, wooden chords, such as 2×4 wood strips, arranged one above the other, and interconnected by diagonally arranged webs or struts made of sheet metal. The webs are fastened, at their opposite ends, to the respective chords by means of nailing or by overlapping them with so-called "connector plates" which are flat plates having struck-out teeth which extend through holes in the web ends, for embedding within the wooden chords. Such types of trusses are normally manufactured in a factory building and transported to a construction site for installation as part of a building.

In the manufacture of such trusses, it is important to first utilize as inexpensive a construction as possible, consistent with providing desired strengths, and also provide an apparatus which rapidly, with minimum labor, permits the assembly of the truss parts in the factory.

The various types of apparatus available for assemblying the metal truss webs to the wooden chords, have been relatively expensive and require considerable labor, particularly because substantial forces are needed for embedding connector plate teeth or nailing devices in the wood. Thus, by way of example, one available device involves a support table upon which the chords are laid so that metal strip webs may be laid over the chords and toothed connector plates may be overlaid over the ends of the webs so that their teeth can extend through holes formed therein for embedding within the wood. Then a roller system is used for applying pressure by means of opposed rollers, to embed the connector plate teeth within the wood. This requires very heavy and substantial construction which results in bulky and expensive apparatus which is relatively slow in operation and requires considerable labor. Other systems, using various types of clamps or presses have equally been of necessity, of substantial and heavy construction and thus relatively expensive.

Thus, the invention herein relates to a simplified, relatively light-weight apparatus for easily assemblying the webs upon the wood chords, with minimum labor and time required. The device herein is of considerably less expense than available devices for manufacturing trusses.

SUMMARY OF INVENTION

The invention herein relates to apparatus for assembling chords using an improved metal web which is of approximately V-shape or chevron-shaped formed of flat sheet metal, to provide a pair of diverging legs forming webs and an integral apex and web end connector plate portions each having struck-out teeth for embedding within the wooden chords. The combination web-connector construction is for applying against the sides only of a pair of vertically aligned chords and is so configured as to easily absorb, transmit and neutralize the various compressive and tensile forces applied to the completed truss.

The chevron construction permits the manufacture of the webs out of a single flat sheet of metal, such as steel, by stamping or slitting successive nested webs, thereby minimizing scrap losses in the manufacturing process. Thus, the completed web construction is relatively inexpensive, easy to handle and easily positionable in place upon aligned chords for assembly thereto.

The apparatus comprises a pair of parallel rails upon which brackets are attached for supporting the chords above and alongside of each of the rails so that web-connectors may be laid upon the rails, teeth upwardly extending, for embedding into the downward faces of the chords and simultaneously, webs may be aligned by laying them over the top faces of the chords to form a truss having aligned webs on opposite faces of the chords. A pair of clamping devices are supported for movement parallel to the rails for selectively clamping aligned pairs of connector portions, on opposite chords, against the wood for embedding the teeth therein. The clamps or presses are of relatively light weight and yet are constructed to apply substantial localized forces. Thus, the overall construction of the apparatus is relatively inexpensive and is easily operable for rapid assembly of trusses using a minimum of labor.

These and other objects and other advantages of this invention will become apparent upon reading the following description, of which the attached drawings form a part.

DESCRIPTION OF THE DRAWINGS

FIG. 1 is a perspective view of a section of the truss which forms a floor or roof deck joist.

FIG. 2 is an enlarged, fragmentary, cross-sectional view of one chord and the attached webs.

FIG. 3 is an enlarged elevational view of a single web-connector, and

FIG. 4 is a side elevational view of the web-connector.

FIG. 5 is a cross-sectional view taken in the direction of arrows 5—5 of one web, and FIG. 6 is a cross-sectional view taken in the direction of arrows 6—6 of FIG. 3 of the apex connector portion of the web-connector.

FIG. 7 illustrates the nesting relationship of the webs as they are formed into blanks from a sheet of metal.

FIG. 8 is a perspective view of the apparatus, and

FIG. 9 is a top plan view of the apparatus.

FIG. 10 is an enlarged end view of the apparatus, taken in the direction of arrows 10—10 of FIG. 9.

FIG. 11 is a view taken in the direction of arrows 11—11 of FIG. 9, showing the presses or clamps.

DETAILED DESCRIPTION

Figure 12:
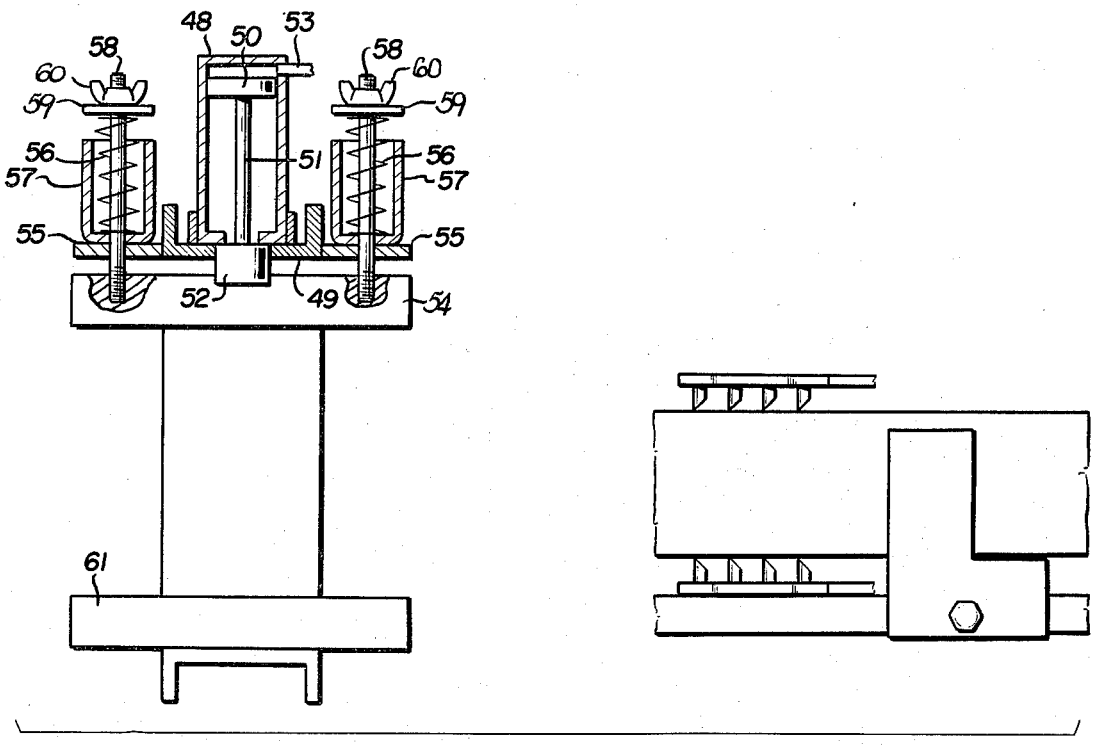
FIG. 12 is an enlarged, front elevational view, partially in cross-section, showing one of the presses and the relationship to the chord and chord support means.
Figure 13:
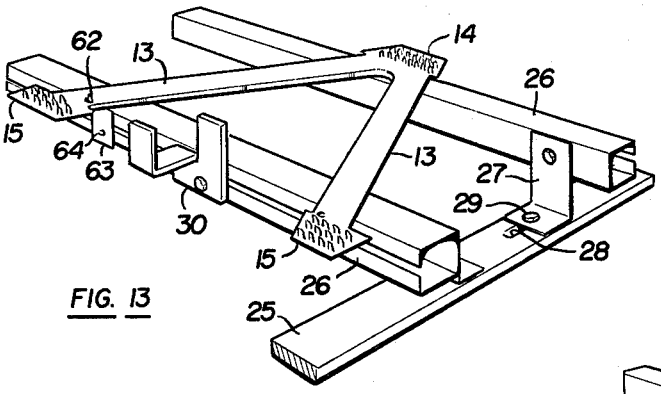
FIGS. 13–15, inclusive, are fragmentary, perspective views of the apparatus, showing the successive steps in locating the parts forming the truss.
Figure 14:
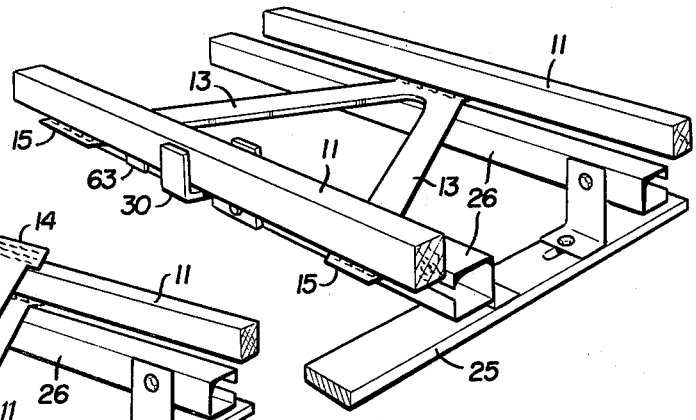
Figure 15:
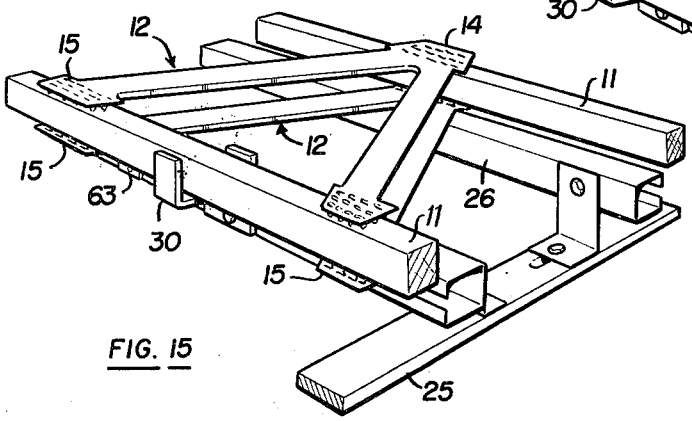

FIG. 1 illustrates a section of a truss type joist formed of a pair of vertically spaced apart wood chord members 11 which may be of conventional 2×4 lumber. The chords are interconnected by diagonally arranged struts or webs formed of sheet metal. Such metal webs 12 are made in a chevron or V-shape to provide web legs 13, an apex connector plate portion 14 and enlarged leg connector portions 15. The connector portions are provided with struck-out spikes or teeth 16 for embedding into the chord members.

The edges of the web legs are bent to form a continuous inner flange 17 which extends substantially the full length of each leg and continues around the arc forming the apex between the legs, and an outer flange 18.

A channel or groove 19 is formed along the length of each leg by bending or impressing for rigidifying the legs in conjunction with the flanges.

As shown in FIG. 7, the web-connectors may be formed by starting with an elongated sheet of metal, such as suitable sheet steel of adequate strength and then blanks 12*a* may be stampted or slit from the sheet. These blanks are in effect, nested, one within the other. To form the complete web-connectors, the blanks are first, partially lanced; second, formed or flanged; third, teeth punched; and last, finally cut off the sheet, while the sheet passes through a progressive die. Thus, as can be seen, in the manufacturing process for forming the web-connectors, there is a minimum of waste material, which obviously reduces the overall cost of manufacture.

The size, i.e., the height of the web-connectors may be varied in the manufacturing process by using stamping dies which have fixed inserts for the connector portions and teeth and removable leg-forming portions which can be interchanged with other leg-forming portions to make the legs longer or shorter, as desired. Thus, the die expense, due to the configuration of the web-connector, is substantially reduced.

As can be seen in FIGS. 1 and 2, the web-connectors are applied in pairs, one on each vertical face of the aligned chords, and their teeth are embedded only into the side faces of the chords. This permits forming the truss by laying one web-connector down upon a horizontal surface, with its teeth upwardly, laying the chords above it and then placing the second or opposing web-connector upon the exposed upper surfaces of the chords, teeth down, so that a single compression or clamping operation at each overlapped connector portion can cause the teeth thereof to move into the wood from opposite sides. Thus, the assembly of the web-connectors to the wood chords is simplified to a considerable extent and permits the use of the apparatus herein.

With the specific design of the web-connector, edge flanges, apex arrangement, etc., the loads applied upon the joist which is formed by this truss, places one leg of each web-connector in compression and the other leg in tension, with the resulting force component, longitudinal of each chord. The net result is balancing or approximate cancellation of vertical force components, and absorbtion of longitudinal force components, as well as resistance against torque or twisting forces. Hence, a good, strong joist is provided using minimal materials.

Referring now to the apparatus for assemblying such truss-type joists, the truss making machine, generally designated at 22, includes a support surface 23 which may be made of a pair of aligned, elongated, horizontal plates 24 supported upon frame cross-members 25 which may be mounted upon suitable legs or framework (not shown). A pair of parallel support rails 26 are located above the plane of the support surface, i.e., above the plane of the plates, by means of angle brackets 27 fastened by bolts 28 to the cross-members 25. The bolts may extend through slots 29 formed in the angle brackets to permit adjustment of at least one rail towards and away from the other.

As illustrated in the drawings, the rails 26 are preferably channel-shaped with inturned ends to form a hallow member having a slot extending along the full length thereof. These are conventionally available cross-sections used for a variety of construction purposes.

Fastened along the rails are a number of upwardly opening support channels or saddles 30, each formed of bent metal having a vertical base 31 which is fastened to its respective rail by a bolt 32 extending through the slot in the rail. Thus, the saddles may be adjusted along the length of the rail and fixed in place as desired. Each saddle provides an upwardly opening channel 33, with all of the saddles on each rail being aligned to receive a single wood chord. The saddles are so formed that a space is provided beneath the chords inserted therein, for positioning a web-connector member upon the rails with the connector portions thereof arranged beneath the chords, i.e., along side the outer sides of the rails, and with their teeth extending upwardly for loosely engaging beneath the chords.

Once the set of web-connector members are positioned along the rails and the chords thereafter arranged in the saddles above them, another set of web-connector members may be positioned upon the upper surfaces of the chords with the teeth thereof extending downwardly and with the connector portions vertically aligned with the connector portions of the web-connectors located on the rails to form opposing pairs of connector portions. The connector portions are then squeezed together, in opposing pairs, to embed their teeth within the wood.

For purposes of clamping or pressing the teeth of the connector portions into the wood, a pair of presses or clamp devices 35 is provided. These presses are each formed of a roughly C-shaped frame 36 having an outer vertical post 37 and an inner vertical post 38 with an upper, horizontal frame member 39 and a lower horizontal frame member 40. The horizontal frame members may be formed of channels as illustrated.

Each of the press frame members are arranged in a substantially vertical plane, on opposite sides of the rails, and the two frames are interconnected by a strut 41 which is angled so as to offset one frame relative to the other. That is, one frame is arranged to be aligned with a vertically aligned pair of web leg connector portions while the other is aligned with corresponding apex connecting portions for simultaneous operation.

One of the frames is provided with a horizontally elongated guide bar or strip 42 upon which rollers 43 are mounted, with the rollers engaging and riding upon a guide rail 44 fastened upon the support surface 23 alongside of one rail. A support roller 45 may be provided on the base of the other frame, so that it may loosely roll along the support surface. If desired, a second guide rail may be provided. However, this will have to be an adjustable one to permit adjustment corresponding to the changes in height of the truss being manufactured.

Each press frame has mounted thereon a vertically arranged compression cylinder 48 which is threadedly engaged into a threaded collar 49 formed upon the upper frame member 39. An internal piston 50 within the compression cylinder is connected by a piston rod 51 to an external force applying piston 52. The compression cylinder may be operated by hydraulic fluid applied through a hydraulic line 53 connected to a suitable source, such as a pump and pressure holding cylinder. The hydraulic system is not described herein since it is of conventional construction and may be varied to supply the pressurized fluid needed.

The piston 52 engages an elongated upper, steel platen 54 for movement of the platen downwardly, towards the connector portions of the web-connector. Metal side extensions 55 are secured, as by welding, to the frame upper member 39 for mounting a pair of compression springs 56, one on each side of the cylinder. These springs are preferably contained within mounting cups 57 through which a central bolt 58 extends so that the spring engages the base of the cup and also against a washer 59 secured upon a bolt by a wing nut 60. This permits adjustment of the compression of the spring. Each of the bolts is engaged with the platen, as by threading therein, to stabilize and distribute the force of moving the platen downwardly. In addition, the compression springs serve to retract the platen when hydraulic pressure is released from the compression cylinder to thereby eliminate the need of a separate hydraulic connection and valves and the like for returning the pressure cylinder upwardly. Thus, the overall construction of the compression means is simplified.

Secured to the lower frame member 40 of each of the frames is a lower platen 61 of the same size and shape as the upper platen and vertically aligned therewith. Thus, the lower platen is arranged to engage the connector portion of a lower web-connector and correspondingly, the upper platen engages the vertically aligned connector portion of the upper web-connector.

In order to facilitate the rapid positioning of the web-connectors upon the rails, a locator pin 62, mounted upon a pin support plate 63 and fastened to the rail by a bolt 64 is arranged at each of the web-connector members, with each having a hole 65 formed in its leg for receiving the locator pin 62.

In operation, the operator of the apparatus first positions a number of web-connectors upon the rails as illstrated in dotted lines in FIG. 9, with their teeth extending upwardly. Then, chord members are placed within the saddles with the chord members located above the connector portions of the web-connectors. Then, a second set of chord-connectors are placed, teeth down, upon the chords, in alignment with the lower set. Next, the operator slides the presses along the length of the support surface to simultaneously align the press on one side with a pair of aligned connector portions and the press on the opposite side with similarly aligned connector portions. Actuation of the hydraulic system causes the platen to lower and thereby squeeze the composite connector portion-chord-connector portion together for embedding the teeth within the wood. Because of the localized nature of the forces, sufficient pressure may be generated to push the teeth into the chords rapidly and fully. Then, deactuation of the hydraulic system by means of a suitable switch, will result in the upper platens raising due to the compression springs and the unit of the two presses may then be slid further to engage two more pairs of connector portions. By simply moving down the line, from one connector portion to the next, the operator may then assemble each of the web-connectors to the chords. Upon completion, the presses are slid out of the way at one end or the other of the support surface and the completed joist may be lifted upwardly and set aside for repeat of the operation. Because the web-connectors each carry their own integral fastening elements, namely, the teeth which embed only into the side faces of the chords (i.e., when the chord is arranged vertically), the entire operation is simplified and may be rapidly performed with minimum labor.

Having fully described an operative embodiment of this invention, I now claim:

1. Apparatus for forming truss-like joists made of a pair of parallel, elongated chords with flat, sheet metal webs overlapping and extending between the chords and secured thereto at the overlapped portions by struck-out teeth, comprising:

a support surface and a pair of parallel rails mounted above the support surface;

a number of upwardly opening U-shaped supports secured to said rails for receiving wooden chords and positioning them above and to the sides of said rails, whereby metal webs may be laid upon said rails so that their ends extend generally transversely of the rails and beneath chords supported within such U-shaped supports;

a pair of presses supported upon said support surface, each adjacent to one of said rails, with each of said presses comprising a generally C-shaped frame arranged in a vertical plane, with one frame opening towards the other and means interconnecting the two frames for joint movement;

guide means formed on said support surface and cooperating guide elements formed on one of said frames for guiding said frame in parallelism along the length of the rails;

a pressure clamp means mounted upon a horizontal leg of each of said frames and an opposing platen mounted upon another leg of said frames in alignment with the clamp means, with said clamp means arranged to overlap its adjacent chord;

wherein webs may be arranged on said rail below said chords and corresponding webs may be arranged upon the upper surfaces of said chords in alignment with the first mentioned webs and said clamp means may be each aligned with a pair of opposed tooth portions formed on said webs so that actuation of said clamp means squeeze the webs towards the chords for embedding their teeth therein.

2. Apparatus as defined in claim 1, and said clamp means each comprising a fixed fluid operated cylinder having a piston movable outwardly therefrom and engaging a platen for applying pressure; and a compression spring mounted upon fixed supports on opposite sides of the cylinder for spring urging guide bolts connected to said platen in a direction away from the platen for thereby guiding said platen as well as retracting the piston and the platen towards said cylinder.

3. Apparatus as defined in claim 1, and at least one of said rails being mounted for selective movement towards and away from the other rail for adjusting and fixing the space therebetween.

4. Apparatus as defined in claim 1 and further including locater means secured to one of said rails to align and position the sheet metal web beneath said chords.

5. Apparatus as defined in claim 4 wherein said press means includes a generally C-shaped frame arranged in a vertical plane, said pressure clamp means and said opposing platen mounted on said C-shaped frame.

6. Apparatus as defined in claim 1 wherein said U-shaped supports are adjustable along the length of said rails.

7. Apparatus for forming truss-like joists made of a pair of parallel, elongated cords with flat, sheet metal webs overlapping and extending between the chords and secured thereto at the overlapped portions by struck-out teeth, comprising:

a support surface and a pair of parallel rails mounted above the support surface;

a number of upwardly opening U-shaped supports secured to said rails for receiving wooden cords and positioning them above and to the sides of said rails, whereby a number of webs may be loosely placed upon the rails with their overlapping portions arranged beneath the chords and their teeth extending upwardly towards the chords, and a corresponding number of webs may be loosely arranged upon the chords with their overlapping portion teeth extending downwardly;

press means supported upon said support surface, adjacent to one of said rails;

guide means formed on said support surface and cooperating guide elements formed on one of said frames for guiding said press means along the length of the rails;

a pressure clamp means mounted upon a horizontal leg of said press means and an opposing platen mounted upon another leg of said press means in alignment with the clamp means, with said clamp means arranged to overlap its adjacent chord;

wherein webs may be arranged on said rail below said chords and corresponding webs may be arranged upon the upper surfaces of said chords in alignment with the first mentioned webs and said clamp means may be each aligned with a pair of opposed tooth portions formed on said webs so that actuation of said clamp means squeeze the webs towards the chords for embedding their teeth therein.

8. Apparatus for forming truss-like joists made of a pair of parallel, elongated chords with flat, sheet metal webs overlapping and extending between the chords and secured thereto at the overlapped portions by struck-out teeth, comprising:

a support surface and a pair of parallel rails mounted above the support surface;

a number of upwardly opening saddle supports secured to said rails for receiving wooden chords and positioning them above and to the sides of said rails, whereby metal webs may be laid upon said rails so that their ends extend generally transversely of the rails and beneath chords supported within such saddle supports;

a pair of presses supported upon said surface, each adjacent to one of said rails, with each of said presses comprising a generally C-shaped frame arranged in a vertical plane, with one frame opening towards the other and means interconnecting the two frames for joint movement;

guide means formed on said support surface and cooperating guide elements formed on one of said frames for guiding said frame in parallelism along the length of the rails;

a pressure clamp means associated with each of said presses, each pressure clamp means upon a horizontal leg of one of said frames and an opposing platen mounted upon another leg of each of said frames in alignment with the clamp means, with said clamp means arranged to overlap its adjacent chord;

each pressure clamp means being actuated for relatively moving together each pressure clamp means and its respective opposing platen;

wherein when webs may be arranged on said rail below said chords and corresponding webs may be arranged upon the upper surfaces of said chords in alignment with the first mentioned webs and said clamp means may be each aligned with a pair of opposed tooth portions formed on said webs so that actuation of said pressure clamp means squeezes the webs towards the chords for embedding their teeth therein.

* * * * *